US008926123B2

(12) United States Patent
Thrailkill

(10) Patent No.: US 8,926,123 B2
(45) Date of Patent: Jan. 6, 2015

(54) SOLID STATE LIGHTING DEVICE

(76) Inventor: John E. Thrailkill, Shelburne, VT (US)

( * ) Notice: Subject to any disclaimer, the term of this patent is extended or adjusted under 35 U.S.C. 154(b) by 176 days.

(21) Appl. No.: 13/697,890

(22) PCT Filed: Apr. 28, 2011
(86) PCT No.: PCT/US2011/000741

§ 371 (c)(1),
(2), (4) Date: Nov. 14, 2012

(87) PCT Pub. No.: WO2011/149504

PCT Pub. Date: Dec. 1, 2011

(65) Prior Publication Data

US 2013/0063935 A1 Mar. 14, 2013

Related U.S. Application Data

(63) Continuation-in-part of application No. 12/785,602, filed on May 24, 2010, now Pat. No. 8,414,147.

(51) Int. Cl.

| | |
|---|---|
| ***F21V 5/04*** | (2006.01) |
| ***F21V 29/00*** | (2006.01) |
| ***F21K 99/00*** | (2010.01) |
| ***F21S 8/00*** | (2006.01) |
| ***F21S 8/06*** | (2006.01) |
| ***F21V 3/02*** | (2006.01) |
| ***F21V 7/20*** | (2006.01) |
| *F21Y 101/02* | (2006.01) |
| *F21V 3/00* | (2006.01) |
| *F21V 13/04* | (2006.01) |
| *F21V 17/00* | (2006.01) |
| *F21V 17/16* | (2006.01) |

(52) U.S. Cl.

CPC ..... *F21V 29/004* (2013.01); *F21V 29/2212* (2013.01); *F21K 9/00* (2013.01); *F21K 9/135* (2013.01); *F21S 8/033* (2013.01); *F21S 8/06* (2013.01); *F21S 8/063* (2013.01); *F21V 3/02* (2013.01); *F21V 7/20* (2013.01); *F21Y 2101/02* (2013.01); *F21V 29/2293* (2013.01); *F21V 3/00* (2013.01); *F21V 13/04* (2013.01); *F21V 17/005* (2013.01); *F21V 17/164* (2013.01)

USPC ..... 362/235; 362/249.02

(58) Field of Classification Search

CPC ..... H01K 2201/09081
USPC ..... 362/235, 241, 547, 249.02, 373
See application file for complete search history.

(56) References Cited

U.S. PATENT DOCUMENTS 6,626,557 B1 9/2003 Taylor (Continued)

FOREIGN PATENT DOCUMENTS

EP 1 705 421 A2 9/2006

*Primary Examiner* — Vip Patel
(74) *Attorney, Agent, or Firm* — Cesari and McKenna, LLP

(57) ABSTRACT

A solid state lighting device includes a relatively rigid, thermal dissipation plate with opposite sides, a printed circuit in intimate thermal contact with one side of the plate, at least one LED positioned against and electrically connected to the printed circuit and a shell having a rim secured to the one side of the plate so that the shell substantially covers the LED whereby when the LED is energized, light therefrom radiates into the shell and heat from the LED is conducted away by the plate.

39 Claims, 14 Drawing Sheets

(56) References Cited

U.S. PATENT DOCUMENTS

| | | | |
|---|---|---|---|
| 7,111,961 | B2 | 9/2006 | Trenchard et al. |
| 7,255,457 | B2 | 8/2007 | Ducharme et al. |
| 7,288,902 | B1 | 10/2007 | Melanson |
| 7,815,338 | B2 | 10/2010 | Siemiet et al. |
| 2010/0134047 | A1 | 6/2010 | Hasnain |
| 2011/0141729 | A1 | 6/2011 | Yang et al. |

SOLID STATE LIGHTING DEVICE

CROSS-REFERENCE TO RELATED APPLICATION

This application is a continuation-in-part of Ser. No. 12/785,602, filed May 24, 2010, the contents of which is hereby incorporated by reference herein.

BACKGROUND OF THE INVENTION

The present invention relates generally to a solid state lighting device or source of the general purpose type. In particular, the invention relates to such a device which comprises a component system incorporating light emitting diodes (LEDs) in order to simulate general purpose incandescent lighting devices.

The present invention further concerns lighting fixtures that incorporate the aforementioned component system in either a single sided or double sided (opposed) configuration.

General purpose LED lighting devices are used primarily in residential and commercial office settings. LED light sources, as well as compact fluorescent (CFL) and linear fluorescent light sources, are generally recognized as the likely replacements for incandescent lighting due to regulatory phase-out of the latter in the years ahead.

Incandescent lighting remains the most popular general purpose lighting technology due to its low initial purchase price and the high quality of its light output. Incandescent bulbs sell for pennies and they provide a diffuse source of broad spectrum illumination that renders colors accurately. In addition, they are capable of task-type lighting at higher power settings, yet can be dimmed down to create very "warm" effect-type lighting at lower power settings. Incandescent lighting remains popular despite the high cost of ownership due to low efficiency and short product life span, especially when the lighting is cycled on and off frequently.

Fluorescent lighting technology is the most popular alternative to incandescent lighting due to a reasonably low initial purchase price, high efficiency, highly diffuse light output and at least the perception of long bulb life. As with incandescent sources, however, life span is greatly reduced when the bulbs are frequently cycled on and off. Fluorescent lighting also suffers from what is generally considered an unnatural quality of light output. Also, dimming a fluorescent product is problematic in that only certain types can be dimmed and then only over a narrow output range. Further, fluorescent products are not capable of spectrally "warming up" at lower power input levels and may even "cool down", creating an even more unnatural effect. In addition, toxic materials, e.g. mercury, employed in the manufacture of the fluorescent devices require a special disposal process that is often ignored, leading to environmental damage.

LED lighting technology offers the promise of high efficiency, long life and benign environmental impact. Increasingly, the technology is providing high quality spectral output with good color rendering ability. However, the current state of the art has a number of major shortcomings. For example, LEDs are directional light emitters. The high degree of secondary diffusion required to create "soft", diffuse lighting effects can greatly reduce the overall efficiency of an LED lighting fixture. LEDs also produce very stable spectral output with respect to input power. While this is beneficial for a number of technical applications, the LEDs cannot be dimmed to produce the warmer light output that many consumers prefer for general lighting. Lastly, LEDs can only dissipate waste heat through the process of thermal conduction. Unfortunately, most lighting fixtures have been designed for incandescent light sources where radiation is the primary mode of waste heat dissipation. Resultantly, the life span of LEDs in a conventional lighting device can be reduced greatly because of this mismatch in thermal dissipation modes.

SUMMARY OF THE INVENTION

It is, therefore, an object of the present invention to provide a high efficiency LED lighting device or source which emulates the lighting characteristics of an incandescent light source.

Another object of the invention is to provide a solid state lighting device that can emit diffuse light whose color temperature may be varied.

A further object of the invention is to provide a LED lighting device consisting of a component system which simultaneously reflects light emitted by the LEDs and efficiently dissipates the waste heat produced thereby.

Still another object of the invention is to provide such a light source which is relatively easy to make and to assemble.

A further object is to provide a LED light source of this type which can be incorporated into a variety of different light fixtures.

Another object of the invention is to provide a modular light fixture composed of a plurality of such solid state light sources.

Still another object of the invention is to provide a LED light source having the form of a bulb that can be screwed into a standard lamp socket.

Other objects will, in part, be obvious and will, in part, appear hereinafter.

The invention accordingly comprises the features of construction, combination of elements and arrangement of parts which will be exemplified in the construction set forth hereinafter, and the scope of the invention will be indicated in the claims.

Briefly, my solid state lighting device comprises a component system that includes at least one LED, at least one shell, usually a photonic diffuser, covering the LED, combined with a relatively thin thermal dissipator in such a way as to efficiently dissipate waste heat from the LED and reflect the light emitted therefrom. The LED is powered by a drive circuit in the form of a printed circuit, which may be a multi-channel version, so that the light from the device may emulate that from a conventional incandescent bulb.

In this application, the following definitions shall apply:

LED—(Light Emitting Diode) a semiconductor device that produces electromagnetic radiation when excited with an electrical charge. LED may refer to the diode chip or die itself, or may refer to a device or package which provides a means for mounting and encapsulating the diode as well as distributing electrical current to and from the diode. LED may also refer to a device or package that includes the diode as well as a board or plate to which the diode is mounted and with an encapsulant or other photonic material.

PCB—(Printed Circuit Board)—an electrically insulating board or panel that provides both the means for mounting, and the electrical interconnection between, the devices in a circuit. PCBs are typically laminar constructions with a substrate and printed circuits or traces affixed to one or both sides of the substrate. A thermally conductive PCB may have a thermally conducting, electrically insulating substrate e.g. a ceramic plate, in which case a printed circuit is printed on one or both sides of the substrate or an electrically conducting substrate, e.g. a metal plate, in which case a thin, electrically insulating layer is interposed between the substrate and each circuit or trace. If the PCB has a non thermally conducting substrate, the PCB may be made thermally conductive by printing relatively wide/thick circuits or traces on one or both sides of the substrate with thermally conductive feedthroughs in the substrate connecting the circuits.

In certain lighting devices to be described, the LED is located on one side of a small PCB, along with electrical leads to the LED, the opposite or back side of the PCB being substantially flat. The PCB is supported by a mounting frame having opposite first and second sides and an open center so that the back side of the PCB is more or less flush with the first side of the frame and the LED is opposite the open center. A cup-like shell having a rim is secured to a second side of the mounting frame so that the shell surrounds the frame and covers the LEDs. Preferably the shell diffuses light from the LED unless the LED itself includes a diffuser in which case the LED shell may be clear or transparent. A cable may be provided which has one end connected electrically to appropriate leads on the PCB and a second end located beyond the frame for connection to a power source to activate the LED.

According to the invention, the aforesaid PCB, mounting frame and shell constitute a subassembly which may be fastened to one side of the thermal dissipator which has the form of a relatively rigid, thermally conductive plate so that the back side of the substrate is in intimate thermal contact with the plate and the shell rim abuts the plate. Resultantly, when the LED is activated, a maximum amount of light from the LED issues from the source while waste heat from the LED is efficiently conducted away by the plate.

As we shall see, the aforesaid plate, which may function both as a heat sink and as a reflector, may be flat or have a variety of different shapes to direct or distribute the light from the LED in various ways depending upon the particular application. Also, a plurality of the subassemblies may be combined in different ways to provide a variety of different lighting effects.

In an other lighting device embodiment to be described, the thermal dissipater and PCB are combined so that the LED circuit and LED driver circuits are printed on the thermal dissipater and each LED is mounted directly to the thermal dissipater. This reduces the number of required parts and thus simplifies assembly of the device.

Desirably, in both embodiments, the LED in the light source or device may have different color temperatures so that they may be mixed and separately controlled so that the source may emit light which emulates that from a standard incandescent bulb which most people seem to prefer and which can be dimmed in a similar way to the light from such a bulb.

BRIEF DESCRIPTION OF THE DRAWINGS

For a fuller understanding of the nature and objects of the invention, reference should be made to the following detailed description taken in connection with the accompanying drawings, in which.

DESCRIPTION OF THE PREFERRED EMBODIMENTS

Figure 1:
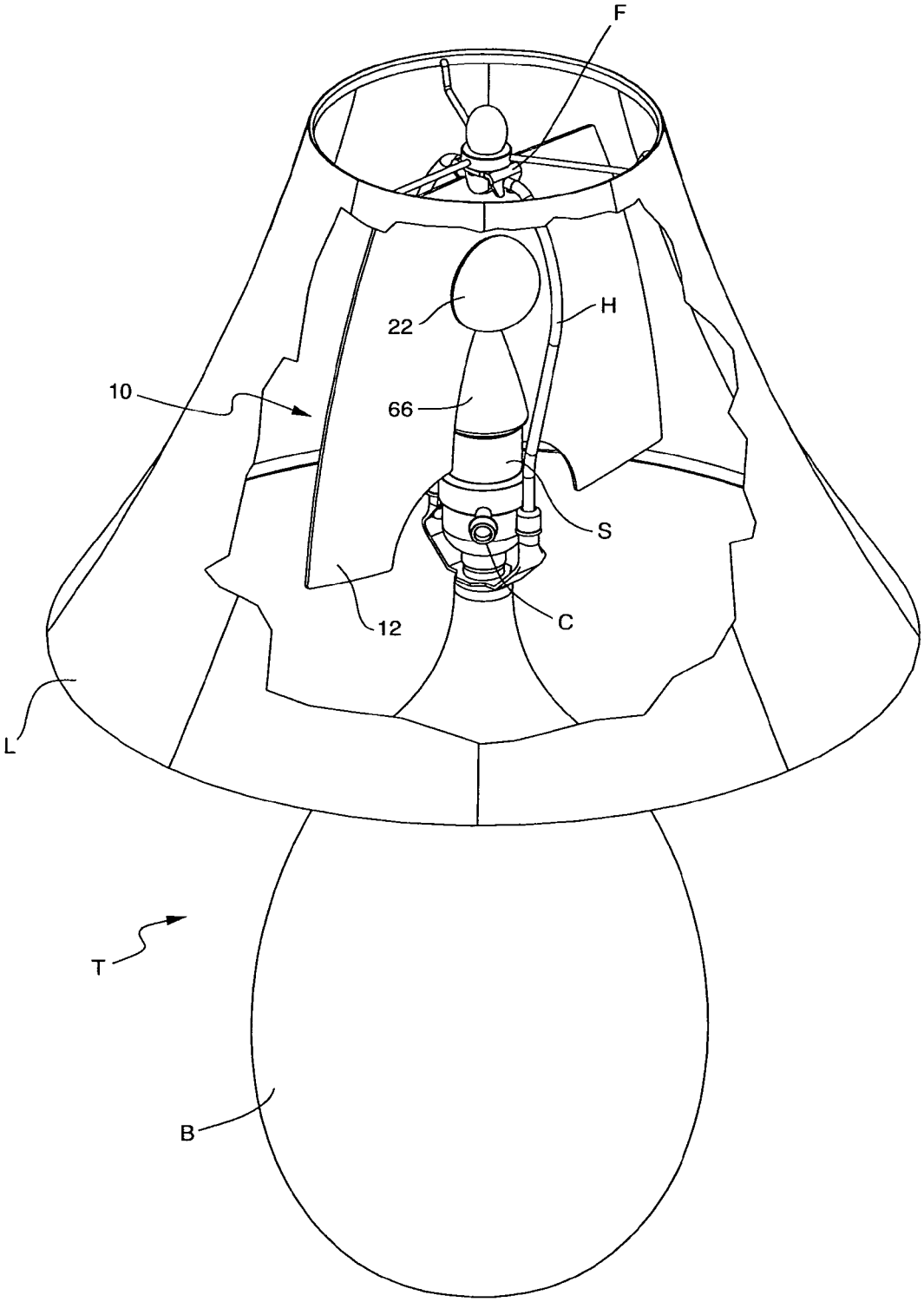
FIG. 1 is a perspective view with parts broken away showing a table lamp incorporating a two-sided lighting device according to the invention.

Refer now to FIG. 1 of the drawings which shows generally at 10 a two-sided solid state lighting device or source according to the invention incorporated into a table lamp T. Lamp T has a base B which may support a conventional switchable socket S whose switching control C extends from the side of the socket. A conventional harp H is mounted to the top of base B just below the socket and extends up and around device 10 so that it can support a lampshade L. For convenience, we will refer to device 10 in this lamp context as a "bulb" because it can be turned on and off like a regular incandescent bulb by operating the switch control C. Also, by separating harp H with shade L from socket S in the usual way, the bulb 10 can be screwed into socket S like a conventional incandescent bulb.

Figure 2:
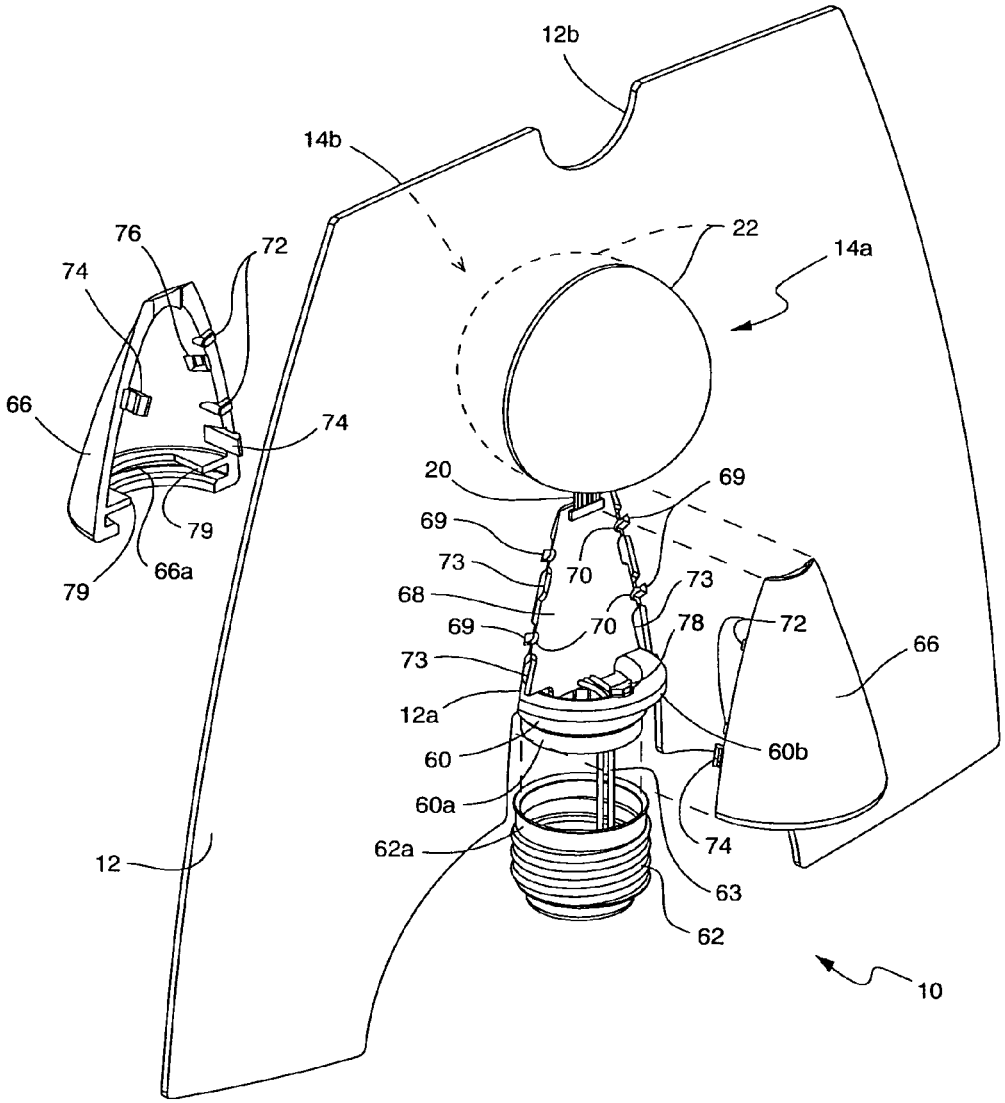
FIG. 2 is an exploded perspective view of the FIG. 1 device.
Figure 3:
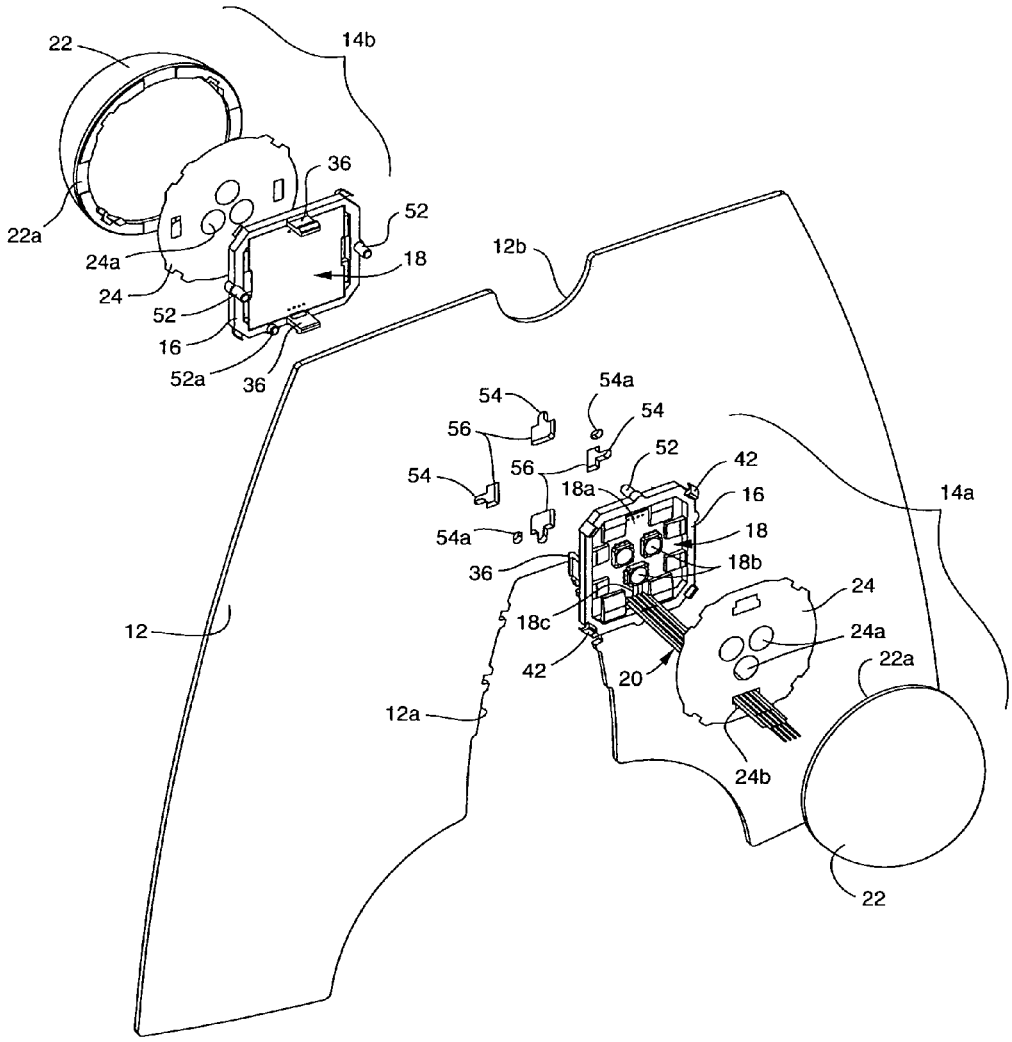
FIG. 3 is an exploded perspective view showing individual subassembly components of the FIG. 1 device.

Referring now to FIGS. 1 to 3, in this embodiment, the bulb 10 is a component system comprising a thermal dissipator in the form of a flat, thermally conductive and preferably reflective plate 12 which is shaped and dimensioned so that it may be centered on edge within the lampshade L so that the plate extends more or less perpendicular to harp H. The plate is formed with notches 12*a* and 12*b* at its bottom and top, respectively, to provide clearance for the socket S and the lampshade fastener F at the top of the harp. The plate may be perforated to increase its surface area; see FIG. 12. Positioned on opposite sides of plate 12 is a pair of mirror-image subassemblies 14*a* and 14*b* which may be fixated to the plate so that they are located directly opposite one another.

Each subassembly 14*a*, 14*b* includes a mounting frame 16 which supports a PCB 18 having one or more LEDs 18*b* on the side of the PCB substrate 18*a* facing away from plate 12. The leads 18*c* from the LEDs on the PCB may be connected via cable 20 to a power source to be described later.

Each subassembly 14*a*, 14*b* also includes a shell 22 having a rim 22*a* and which engages around the frame 16 and covers all the LEDs 18*b*. Although the shell may be transparent, the illustrated shell is translucent or frosted so that the LEDs, when energized, project diffuse light beyond the shell. The shell may be a so-called "high dome" shell which is hemispherical in shape as in FIG. 2 or have a lower profile "low dome" oblate hemispherical shape as in FIG. 6.

Preferably, each subassembly 14*a*, 14*b* may also include a flat reflector 24 positioned between frame 16 and diffuser 22 which, when those components are assembled, spans the shell just inside rim 22*a*. Reflector 24 may comprise a thin, highly reflective sheet, such as a metallized plastic film, whose reflective surface faces the shell. The illustrated reflector has two slots 24*b* which may provide clearance for a cable 20 when the components are assembled. Openings 24*a* are provided directly opposite LEDs 18*b* so that light from the LEDs passes through those openings and through the shell wall to the outside. Any light back scattered from that wall is reflected by reflector 24 back into the shell so that a maximum amount of light from the LEDs is transmitted through the shell wall to the outside.

When the two subassemblies 14*a*, 14*b* are secured at opposite sides of plate 12, the rims 22*a* of the two shells 22 abut those sides, thereby concealing frames 16 and their contents.

Preferably, but not necessarily, cable 20 illustrated in FIG. 3 extends through one of the openings in plate 12 so that its conductors may also connect to the leads 18*c* of the other PCB 18 so that the LEDs on both PCBs are in series with a power source as will be described later.

Figure 4A:
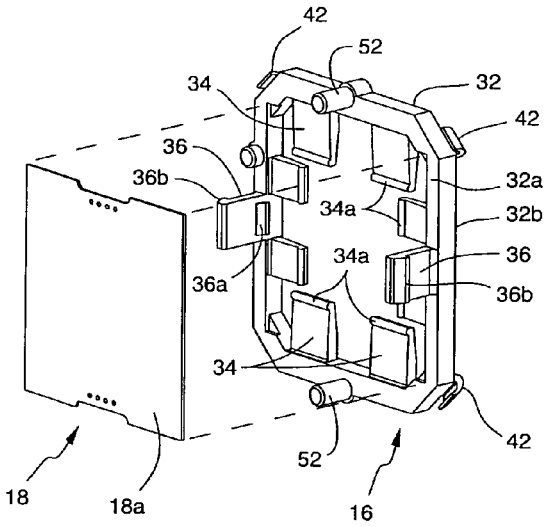
FIGS. 4A to 4F are perspective views showing the FIG. 3 components in greater detail.
Figure 4B:
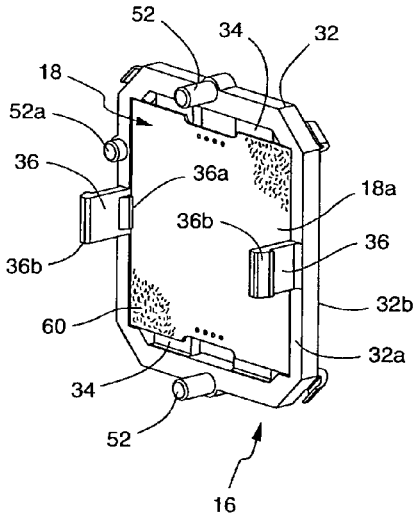

Refer now to FIGS. 4A to 4F which depict the components of each subassembly 14*a*, 14*b* in greater detail and show how they interconnect. Each mounting frame 16 comprises a generally rectangular, relatively thick ring 32 having opposite sides 32*a* and 32*b*. Extending inwardly from the ring between its sides is a plurality of flat fingers 34, each finger having a raised seating surface 34*a* at its free end on which a PCB 18 may rest. When PCB 18 is seated on fingers 34, the back side of the PCB substrate 18*a* is more or less flush with the side 32*a* of ring 32 as shown in FIG. 4B.

As best seen in FIGS. 4A and 4B, a pair of tabs 36 extend from the ring side 32*a* at opposite edges of the frame 16. The tabs 36 are formed with noses 36*a* near their roots which face toward each other so that when the PCB 18 is seated on fingers 34, the noses 36*a* overlie the back side of the PCB so as to retain the PCB against fingers 34. In other words, the tabs 36 and their noses 36*a* function as clips to secure the PCB to the corresponding frame 16.

Figure 4C:
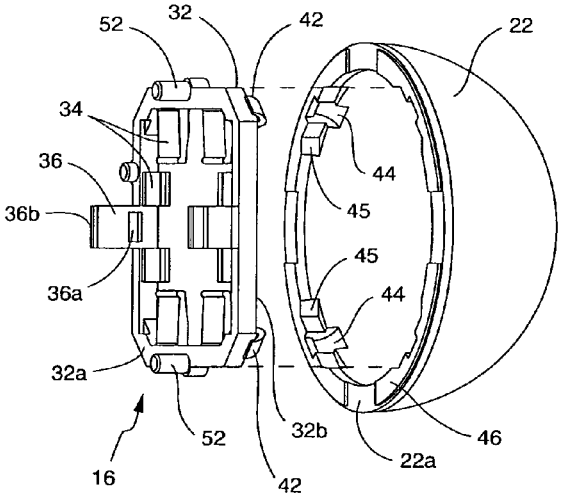
Figure 4D:
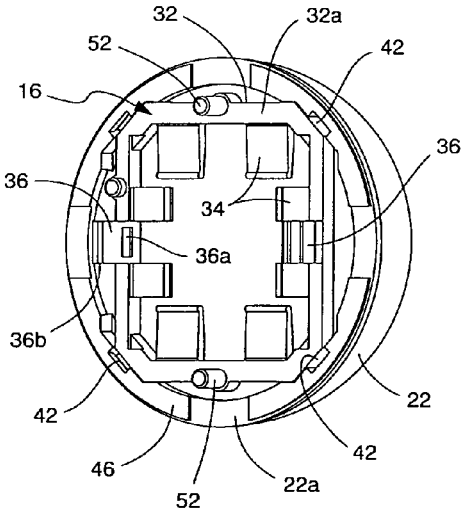

Referring now to FIGS. 4C and 4D, the frame 16 also includes devices for securing the shell 22 to the front side 32*b* of ring 32. More particularly, clips 42 are formed at the corners of side 32*b*. The clips extend outwardly and laterally from the ring 32, curving back on themselves to some extent. The clips 42 are adapted to engage a corresponding plurality of detents 44 formed at frame seats 45 within the shell 22. In other words, the detents 44 and seats 45 are set in from the shell rim 22*a*. Thus, when the shell is engaged around frame 16 such that the frame rests on seats 45, the clips 42 engage behind the detents 44 to secure the shell to the frame so that the shell rim 22*a* surrounds frame ring 32 and is flush with the ring side 32*a* as shown in FIG. 4D. While not necessary, a resilient gasket 46 may, if desired, be provided at the shell rim 22*a* to assure that there is no play between the shell 22 and plate 12.

Figure 4E:
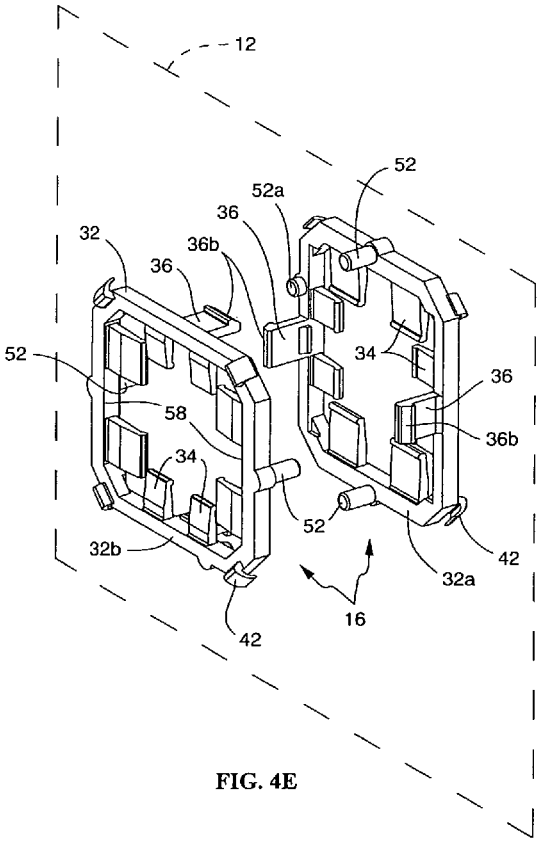

Refer now to FIGS. 3 and 4E, each frame 16 also includes a pair of locating pins 52 projecting from the side 32*a* of each mounting frame ring 32 at opposite edges of the frame. A short ancillary locating pin 52*a* may also project from side 32*a*. The locating pins 52 are adapted to project through corresponding holes 54 in plate 12 and bracket the frame on the other side of the plate to generally locate each frame 16 directly above the notch 12*a* in the plate. The short pin 52*a* on each frame projects through a corresponding hole 54*a* in the plate to accurately fix the position of that frame relative to the plate.

Also, plate 12 is formed with openings 56 for receiving the tabs 36 of each frame 16. Each tab 36 is long enough so that it can extend through a plate opening 56 to the frame 16 at the opposite side of the plate. The end of each tab 36 is formed with an outwardly extending nose 36*b* which can engage behind a notch edge 58 in the latter frame 16. In other words, each tab 36 has a dual function in that its nose 36*a* clips a PCB 18 to the associated frame 16 and its nose 36*b* coacts with the edge 58 of the other frame to secure the two frames against plate 12.

Figure 4F:
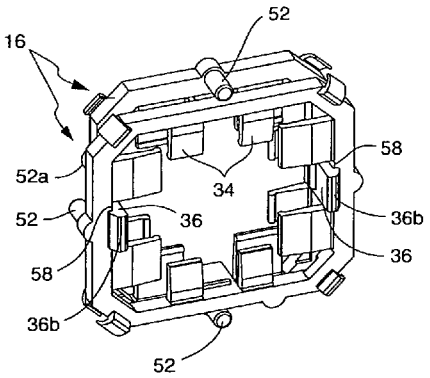

After the PCB 18 and shell 22 have been secured to each frame 16 as described above, the two frames 16, 16 may be positioned with their ring sides 32*a* facing plate 12 and angularly offset 90° as shown in FIG. 4E so that their respective locating pins 52, 52*a* and clips 36 can protrude through the corresponding plate holes 54, 54*a* and openings 56, respectively, in the plate 12 thereby allowing the clip noses 36*b* to interfit with the corresponding notch edges 58 of the opposite frame as shown in FIG. 4F. To accommodate the 90° angular offset of the two frames 16, 16, the plate 12 has duplicate holes 54, 54*a* and openings 56, also offset by 90° as best seen in FIG. 3. When frames 16, 16 are secured to plate 12 as just described, the back sides of the two PCBs 18, 18 are in intimate thermal contact with plate 12 which thus functions as a heat sink to conduct waste heat away from the LEDs 18*b*.

Preferably, the fingers 34 of each mounting frame 16 are flexible and resilient so that when the two frames 16, 16 are clipped together on opposite sides of plate 12, the fingers flex as necessary to accommodate tolerances in the lengths of tabs 36, while still pressing the back sides of the two PCBs 18, 18 against plate 12 to assure that intimate thermal contacts are made with the plate. We should point out also that the clipping together of the two frames 16, 16 causes the frame rings 32, 32 to bow to some extent. To account for this, the locating holes 52 and 52*a* in plate 12 are preferably slightly elongated as shown in FIG. 3.

As is well known in the art, the PCB substrate 18*a* may include thermal tunnels (not shown) under LEDs 18*b* to optimize the thermal paths between the LEDs and the plate. Preferably also, the back side of each substrate 18*a* is covered by a layer 60 of a thermally conductive adhesive as indicated by the stippling in FIG. 4B. Layer 60 may also be made to be electrically non-conductive so as to electrically isolate from plate 12 any printed leads or connections that may be present at the back side of substrate 18*a*.

Referring again to FIGS. 1 and 2, when the light source is designed as a bulb 10 for use in a lamp L, it may include a tubular mount 60 having a lower end 60*a* to which is crimped the rim 62*a* of a more or less conventional conductive, threaded, so-called Edison base 62 that is collinear to plate 12 and adapted to be screwed into the socket S. Of course, the base/socket connection could also be of another type, e.g. a bayonet connection. In any event, when lamp L is plugged into a standard outlet that provides 110 VAC, current flows to wires 63 connecting the contacts in base 62 to a drive circuit that is in, or associated with, bulb 10 to power the LEDs. In this event, plastic covers 66, 66 may be positioned on opposite sides of plate 12 directly below diffusers 22 to secure the mount 60 to the plate 12 and to conceal the cable 20 (FIG. 3) extending down from subassemblies 14*a*, 14*b* as well as, perhaps, a drive circuit for the LEDs. These covers may be of a thermally conductive material, e.g. a metal or metal-filled plastic to help conduct heat away from bulb 10.

The bulb 10 depicted in FIG. 2 does happen to include a circuit board 68 containing a drive circuit. The circuit board 68 is positioned in plate notch 12*a* above base 62 and the drive circuit thereon is electrically connected between cable 20 and the wires 63 from base 62; see FIG. 11. As shown in FIG. 2, the walls of notch 12*a* opposite the edges of circuit board 68 have notches 69 which are matched to mirror-image notches 70 in the edges of the circuit board, the matched notches forming four keyholes. Also, one side edge of each cover 66 is formed with upper and lower keys 72. When the edges of the two covers 66, 66 are pressed against opposite sides of plate 12, their keys 72 project through the keyholes formed by notches 69 and 70 to vertically and laterally locate the mount 60, socket 62 and the circuit board 68 relative to plate 12.

Also, upper and lower openings 73 are provided at each side edge of circuit board 68. These openings provide clearance for clips 74 projecting from the side edges of covers 66, 66 so that when the covers are positioned against the opposite sides of plate 12, the clips 74 on one cover 66 are able to interfit with corresponding detents 76 on the other cover 66. Preferably the lower interior ends of covers 66, 66 are each formed with a channel 66*a* adapted to receive a flange 60*b* on mount 60 so that when the two covers 66, 66 are snapped together, the covers secure mount 60 (and base 62) to plate 12 and they also conceal that connection as well as the circuit board 68.

Referring to FIG. 2, in order to be able to center plate 12 between the legs of the harp H in FIG. 1 after bulb 10 is screwed into socket S, preferably mount 60 is rotatable within channel 66*a* to some extent, the wires 63 being long enough to allow this. A tab 78 may be provided at the top of mount flange 60*b*, positioned to engage stopping surfaces 79, 79 at the opposite ends of channel 66*a* in each cover 66 to allow a rotation of mount 60 within covers 66, 66 of up to 90°.

Figure 5:
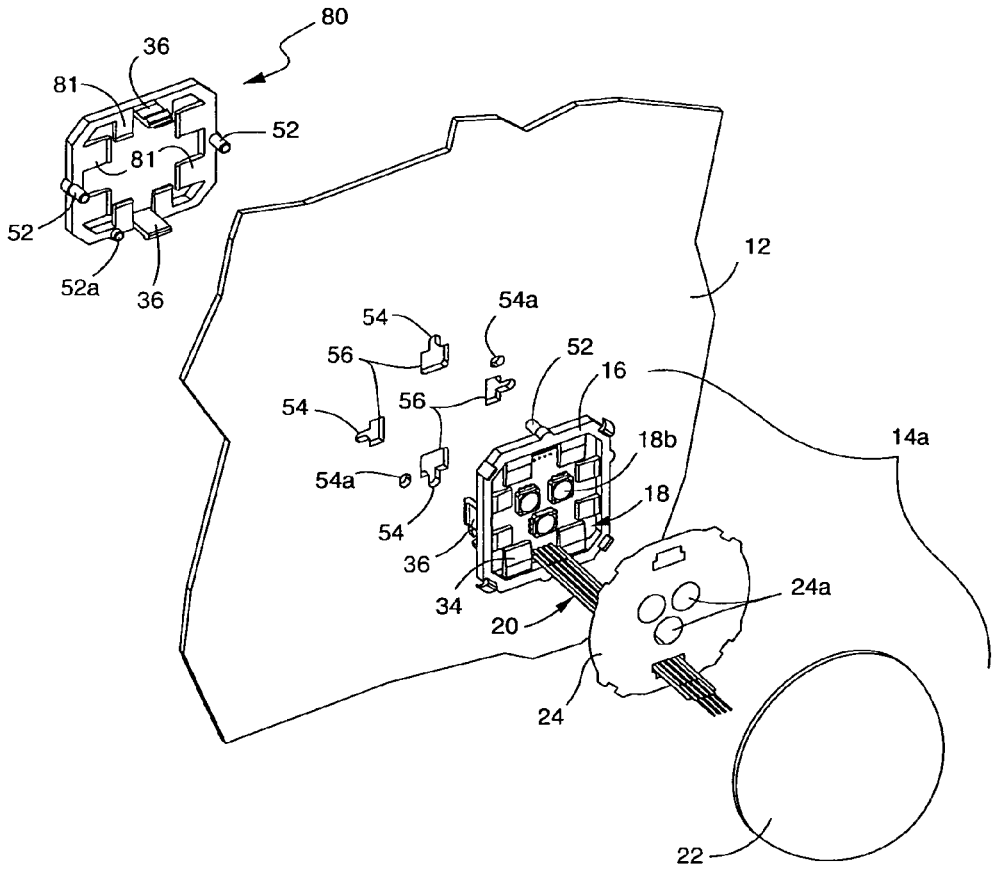
FIG. 5 is a view similar to FIG. 3 showing a single-sided lighting device embodying the invention.

Turning now to FIG. 5, in some applications, a given light source or bulb 10 may have only one subassembly 14*a* or 14*b* secured to plate 12. In this event, when a mounting frame 16 is positioned against one side of plate 12, the locating pins 52 will, as usual, project through locating holes 54 in the plate and the tabs 36 will project through the plate openings 56. The tabs may be shortened so that their noses 36*b* engage behind the edges of those openings. More preferably, a bracket shown generally at 80 in FIG. 5 may be provided with locating pins 52, 52*a* and tabs 36 substantially identical to those on a frame 16 so that the mounting frame 16 shown in FIG. 5 can be clipped to bracket 80 in the same way as it may be clipped to another bracket 16 as shown in FIG. 3. Preferably, bracket 80 also has flexible, resilient fingers 81 somewhat similar to fingers 34 of frame 16. These fingers press against plate 12 when the frame 16 and bracket 80 are clipped together to assure that the PCB 18 in frame 16 makes good thermal contact with the plate.

Figure 6:
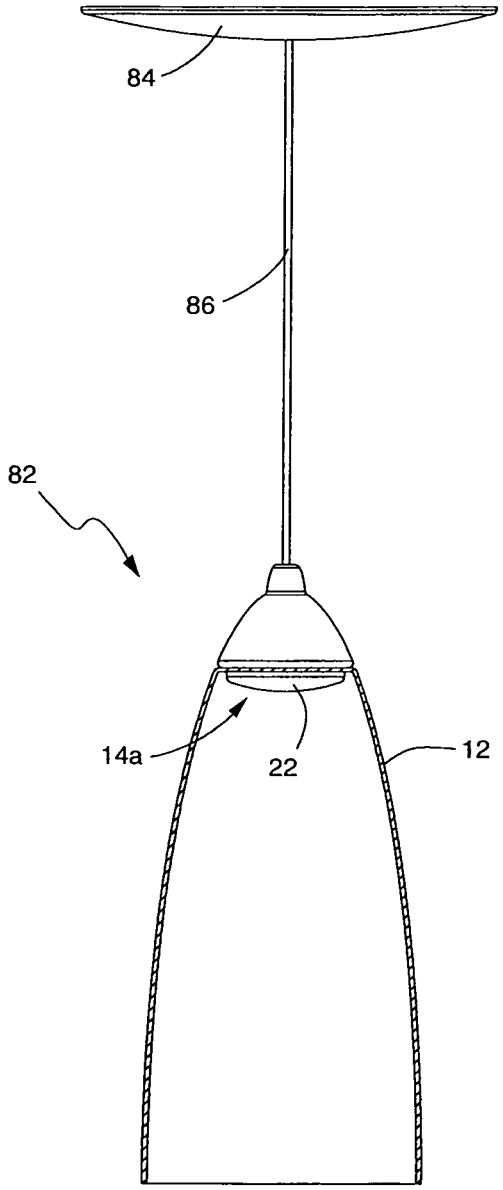
FIGS. 6 to 10 depict the lighting device incorporated into various different luminaires.

In FIG. 5, the plate 12 is shown as having a generalized shape indicating that it can be flat as illustrated in FIGS. 1 and 2 or have any other shape that is dictated by lighting or design considerations. For example, FIG. 6 illustrates a spot light pendant 82 having a single subassembly 14*a* fastened to a heat dissipating plate 12 which has a parabolic shape. In this fixture, the shell 22, e.g. a diffuser, of subassembly 14*a* is preferably of a low dome type so as to limit the re-absorption of light reflected from plate 12 back into the shell. The plate 12 may be conveniently suspended from a ceiling cover 84 by a tube 86 through which a cable 20 (FIG. 3) may be run. The ceiling cover may contain a drive circuit connected to the cable for powering the LEDs in subassembly 14*a*.

Figure 7:
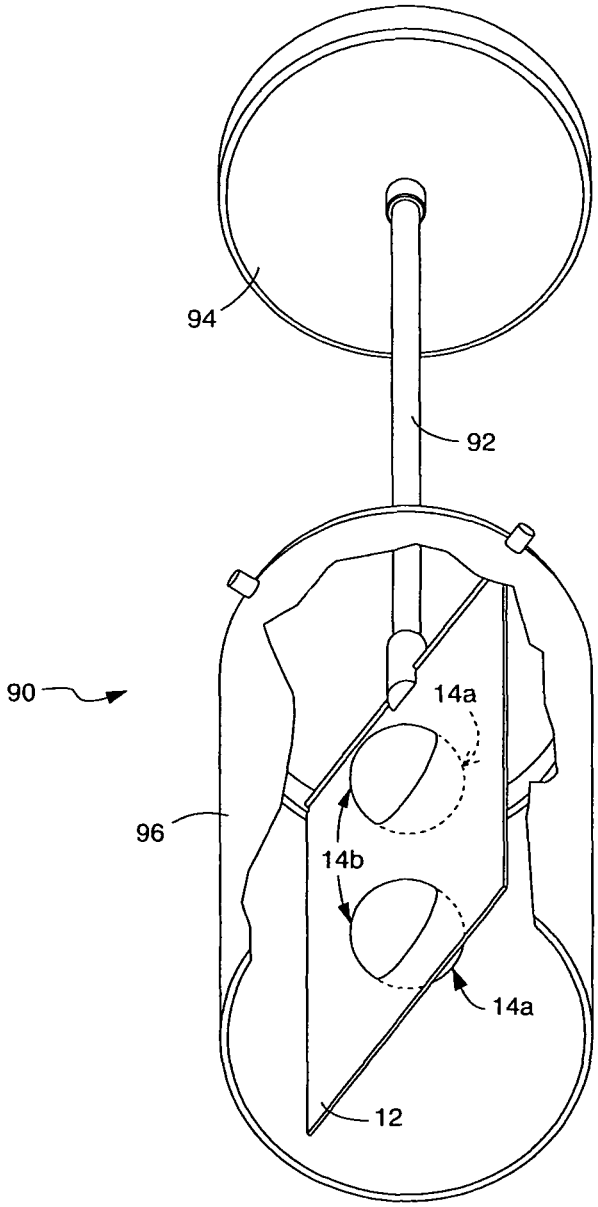

FIG. 7 shows another ceiling pendant indicated generally at 90 which includes subassemblies 14*a*, 14*b* on opposite sides of a plate 12 at upper and lower positions on the plate. In this case, the cable of each subassembly extends through a pendant suspension tube 92 to a ceiling cover 94 that may contain a drive circuit for powering the LEDs in the four subassemblies. Preferably, a translucent or transparent sleeve 96 encircles plate 12 and the subassemblies supported thereby.

Figure 8:
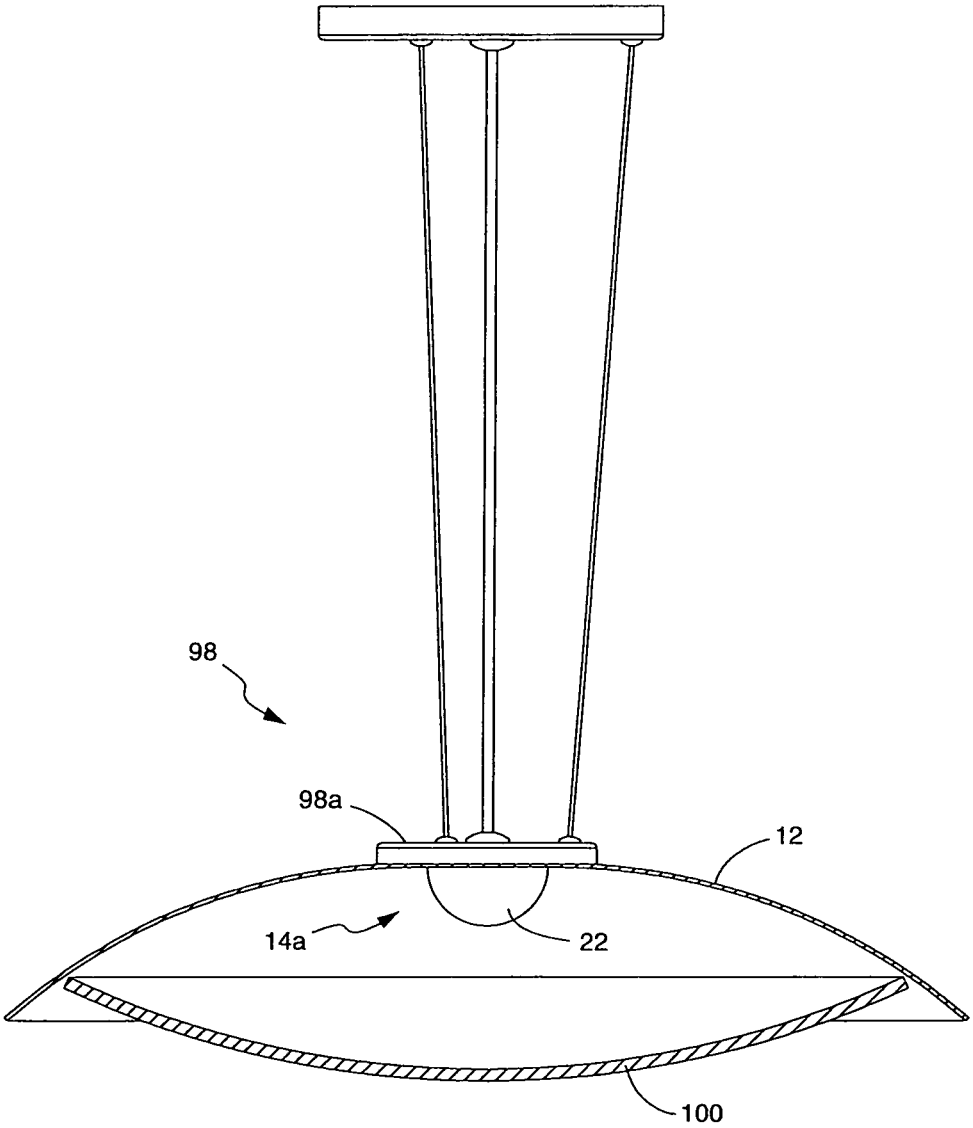

Refer now to FIG. 8 which depicts an area light pendant shown generally at 98 incorporating a single subassembly 14*a* having a high dome shell, i.e. a diffuser, and being secured to a plate 12. The plate functions not only as a heat sink but also as a curved reflector which directs the light from subassembly 14*a* downward through a secondary diffuser 100 secured to plate 12. The pendant 98 may be suspended via its housing 98*a* from the ceiling and powered in the same manner as the previous pendants.

Figure 9:
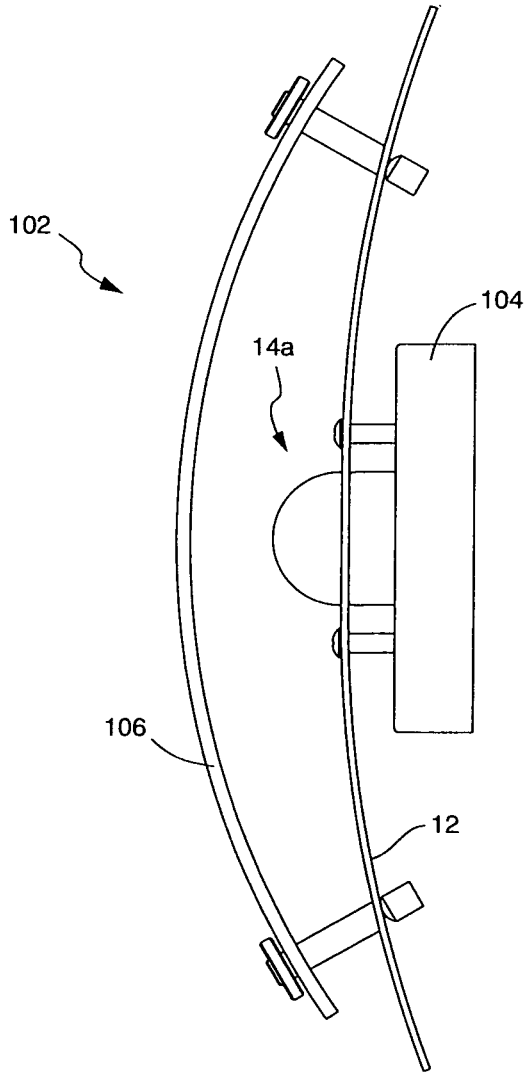

FIG. 9 shows another light source in the form of a wall fixture or luminaire 102 wherein a single subassembly 14*a* is mounted to an outwardly bowed plate 12. In this case, plate 12 is secured to a wall cap 104 at the back of the plate and the light from the subassembly 14*a* is directed through a secondary diffuser 106 mounted to the front of the plate.

Figure 10:
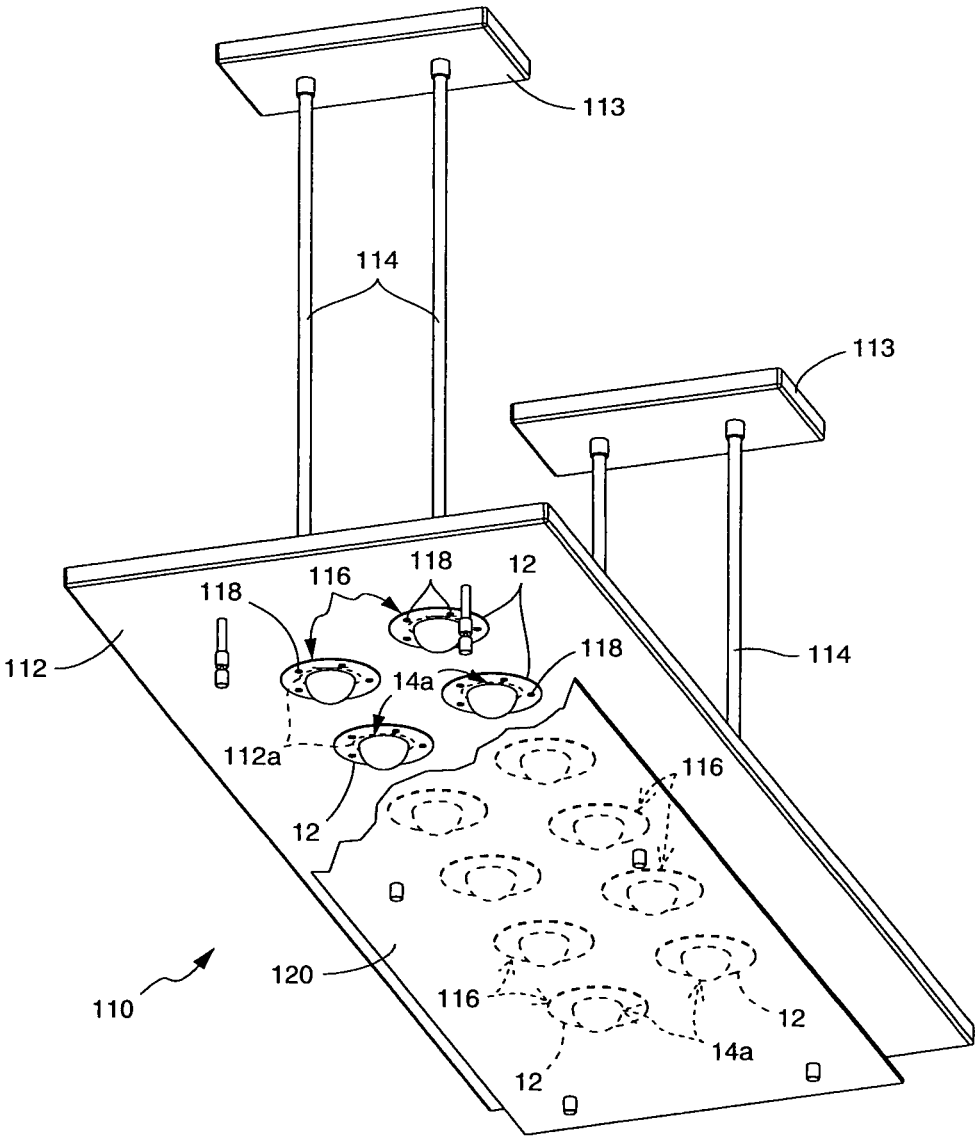

Turn now to FIG. 10 which shows a modular ceiling fixture 110 incorporating the invention. In this case, the fixture includes a large, rigid metal sheet 112 which may be suspended from ceiling covers 113 by tubes 114. The sheet 112 is formed with rows of openings 112*a* for receiving modules 116, each of which includes a subassembly 14*a* fastened to a small plate 12. The plate 12 of each module 116 is releasably secured by suitable fasteners 118 to sheet 112 over an opening 112*a* so that there is intimate thermal contact between each small plate 12 and the large sheet 112. Preferably, a translucent sheet 120 is suspended from sheet 112 to diffuse the light from all the modules 116 in the fixture 110.

The cables 20 (FIG. 3) from the various modules 116 may be coupled to a harness or bus (not shown) leading to a drive circuit in one of the covers 113 to power the LEDs in the modules. Thus, in this embodiment, if one module 116 fails, it can be replaced easily without effecting the other modules simply by separating its plate 12 from sheet 112 and disconnecting its cable 20 from the bus.

While all the LEDs 18*b* in subassemblies 14*a*, 14*b* may be the same in a given bulb 10 or other lighting fixture, more preferably they are divided into groups having different color temperatures with the different groups being separately controllable to vary the overall color temperature of the lighting device at different light intensity levels. This is because, although light from the same LEDs may be dimmed by reducing the drive current to those LEDs, such dimming does not result in the familiar color temperature change associated with conventional incandescent light sources.

Figure 11:
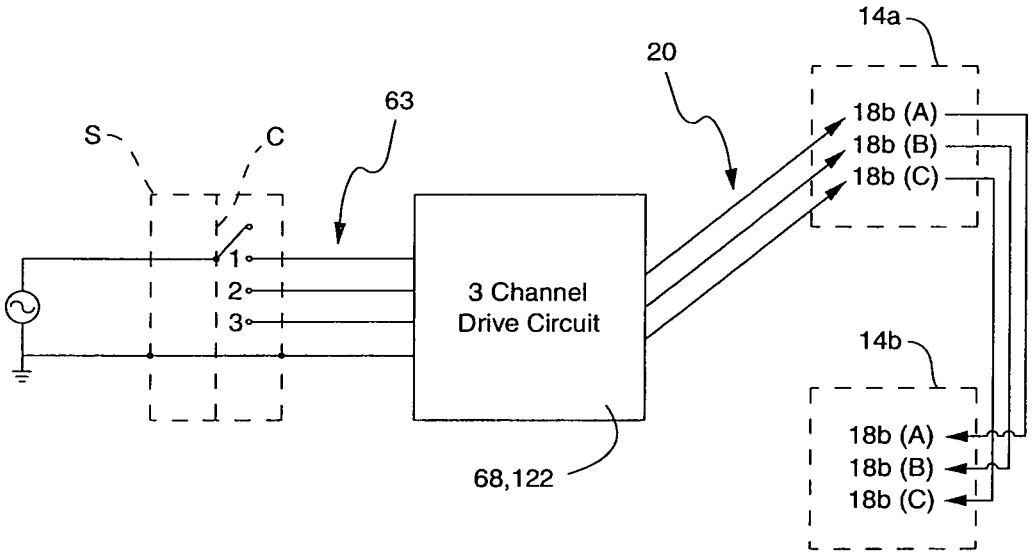
FIG. 11 is a block diagram showing a drive circuit for powering the lighting device.

Thus, for example, the three LEDs 18 in each subassembly 14*a*, 14*b* depicted in FIGS. 3 and 5 may have three different color temperatures A, B and C, respectively. The particular number of LEDs in each subassembly and the particular mix of color temperatures may vary depending on the desired lighting effect. Each of A, B and C may represent the combined or net color temperature from a group of different LEDs. The LEDs in each group may be connected in series via separate leads or channels in cable(s) 20 to a three-channel drive circuit 122 powered, for example, by a 110 VAC, 60 Hz household power source as shown in FIG. 11. The drive circuit 122 may be on a circuit board located in the bulb 10 between covers 66 as shown at 68 in FIG. 2 in which case socket S may be a standard three-way socket, switched by control C to selectively deliver current to the three channels of drive circuit 122. Each channel services a different one of the LED groups A-C in subassemblies 14*a* and 14*b*, delivering 6-7 VDC to the LEDs. The drive circuit could also be located in the base of lamp L and, in the case of the fixtures shown in FIGS. 6-10, behind the ceiling or wall covers of those fixtures, and controlled by a wall switch.

Of course, one or two groups of LEDs 18*b* may be controlled by a one or two-way switch. In fact, the different color temperature LEDs 18*b* may even be dimmed in a continuous manner by a drive circuit such as the one described in U.S. Pat. No. 7,288,902, the contents of which are hereby incorporated herein by reference.

In any event, it is evident from FIG. 11 that the switched socket S is able to activate different LEDs 18 in subassemblies 14*a*, 14*b* at each ON position (1, 2 & 3) of switch control C so that the lighting device may produce light having different color temperatures at three intensity levels to emulate the lighting from a standard three-way incandescent bulb.

Figure 12:
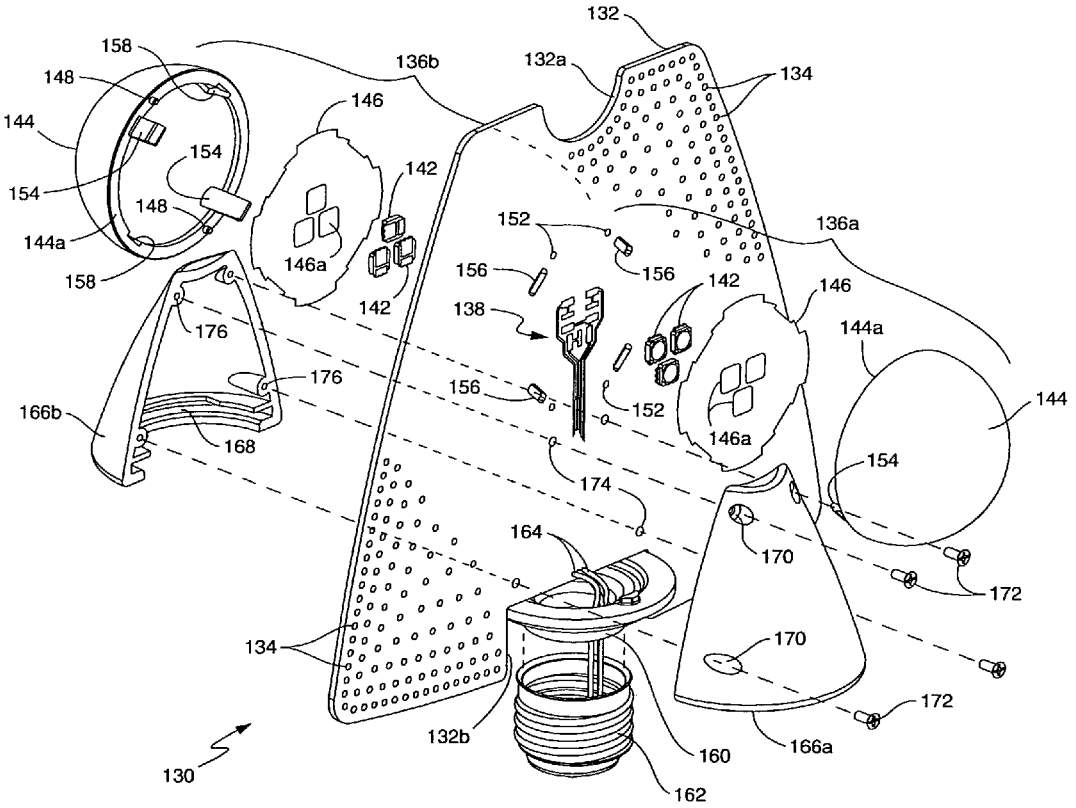
FIG. 12 is a view similar to FIG. 2 showing another device embodiment.

Refer now to FIG. 12 which shows generally at 130 another bulb embodiment incorporating this invention. As before, the bulb includes a flat thermal dissipator in the form of a plate 132 which, like plate 12, has notches 132*a* and 132*b* in its bottom and top edges, respectively. The illustrated plate 132 may be provided with a multiplicity of perforations 134 to provide increased surface area for enhanced thermal dissipation. All the perforations 134 are shown as being round but they may have practically any shape. Of course, similar perforations may be provided in the other plates 12 described above to achieve a similar effect.

Positioned on the opposite sides of plate 132 is a pair of mirror-image subassemblies 136*a* and 136*b* which may be secured to opposite sides of the plate so that they are located directly opposite one another. These subassemblies are similar to subassemblies 14*a* and 14*b* described above except that they do not include the mounting frames 16 to support PCBs. Rather, a printed circuit shown generally at 138 is affixed directly to one or both sides of plate 132 and LEDs 142 are mounted, or soldered, to those circuits. Circuits 138 may include a drive circuit and contact pads to support one or more LEDs 142. Thus, the plate 132 and printed circuits 138, in combination, constitute a thermally conductive PCB which supports and powers LEDs 142 and also dissipates heat therefrom.

If the plate 132 is of a thermally conducting, electrically insulating material, e.g. ceramic, the circuits 138 may be printed directly on the plate; if the plate is of metal, a thin electrically insulating layer should be interposed between the plate and the circuits or traces 138. If the combined thermal dissipation plate 132/circuit 138 should have a non-thermally conductive substrate, e.g. of fiberglass, then the circuits 138 should be constructed in such a way that they provide adequate thermal dissipation and any through holes 134 may be thermally conductive.

Each of the subassemblies 136*a*, 136*b* includes a generally hemispherical shell 144 with a rim 144*a* and which covers LEDs 142 so that the LEDs, when energized, project light through the shell. As mentioned above, each shell may transmit diffuse light from the associated LEDs. Each subassembly may also include a flat reflector 146, similar to reflector 24, positioned between plate 132 and the shell and which spans the shell just inside rim 144*a*. Reflector 146 is provided with openings 146*a* to provide clearance for the light emanating from LEDs 142. When the two subassemblies 136*a*, 136*b* are located against opposite sides of plate 132, the rims 144*a* of the two shells abut those sides so that the reflectors 146 are captured between plate 132 and the shells 144.

The shells 144 have diametrically opposite locating pins 148 which project from rims 144*a* which, when the shells are oriented relatively at a 90° angle, can extend through datum holes 152 in plate 132 to fix the orientations of the diffusers relative to the plate. The shells are secured to opposite sides of the plate by resilient clips 154 which project from the rim of each shell through slots 156 in plate 132 and engage in notches 158 in the other shell.

Like the bulb 10 in FIGS. 2 and 3, the bulb 130 includes a mount 160 to which is crimped a threaded base 162 adapted to be screwed into the socket S (FIG. 1). When the base 162 is connected to a current source, current flows from the socket via wires 164 to the printed circuits 138 so that bulb 130 produces all of the advantages described above.

Bulb 130 also includes a pair of covers 166*a* and 166*b* which are secured to opposite sides of plate 132. To enhance thermal dissipation from bulb 130, the covers may be formed of a thermally conductive material such as a metal or a plastic material filled with thermally conductive particles, e.g. of metal or carbon. Covers 166*a*, 166*b* are provided with notches 168 which releasably engage around base 160 and they are held in place against opposite sides of plate 132 by threaded fasteners 172 which extend through holes 170 in cover 166*a* and registering holes 174 in plate 132. the fasteners are turned down into threaded holes 176 in cover 166*b*. The tightened fasteners 172 assure intimate thermal contact between the covers and plate 132.

The bulb 130 depicted in FIG. 12 has all of the advantages of bulb 10 yet is simpler and easier to assemble because it does not require frames 16 and separate PCBs.

While bulb 130 has the LED driver(s) incorporated into the printed circuit(s) 138, in some applications, the driver(s) may be provided on a separate circuit board positioned just above base 160 and captured between the two covers 166*a* and 166*b*.

Of course, the bulb 130 may have one or more LEDs on only one side of plate 132 and be used as a ceiling or wall fixture as described above in connection with FIGS. 5 to 10.

It will thus be seen that the objects set forth above, among those made apparent from the preceding description, are efficiently attained. Also, certain changes may be made in the constructions set forth without departing from the scope of the invention. For example, in some applications, to conceal cable 20, a bulb 10, 130 may have two identical plates 12, 132 sandwiched together with the cable extending between them. A thermally conductive adhesive may be utilized to bond the plates together. Therefore, it is intended that all matter contained in the above description or shown in the accompanying drawings shall be interpreted as illustrative and not in a limiting sense.

It is also to be understood that the following claims are intended to cover all of the generic and specific features of the invention described herein.

The invention claimed is:

1. A solid state lighting device comprising a relatively rigid, thermally conductive, plate having a first side and a second side, the first and second sides being located oppose each other;

a first subassembly connected to the first side of the plate, the first subassembly comprising:

(a) a printed circuit in intimate thermal contact with one side of the plate;

(b) at least one LED positioned against and electrically connected to the printed circuit, and (c) a shell having a rim secured to said one side of the plate so that the shell substantially covers the at least one LED whereby when the at least one LED is energized, light therefrom radiates into the shell and heat from the at least one LED is conducted away by the plate; and a second subassembly connected to the second side of the plate, the second subassembly similar elements to the first subassembly.

2. The device defined in claim 1 wherein said plate is reflective of light emitted by the at least one LED.

3. The device defined in claim 1 wherein said at least one LED comprises a plurality of LEDs.

4. The device defined in claim 3 wherein the plurality of LEDs include LED groups having different color temperatures, and further including a plural-channel drive circuit connected to said plurality of LEDs for separately controlling the different LED groups.

5. The device defined in claim 1 wherein the plate is perforated to increase its surface area.

6. The device defined in claim 1 wherein the shell is of a substantially transparent material.

7. The device defined in claim 1 wherein the shell is of a translucent material.

8. The device defined in claim 1 wherein the plate is a thermally conductive PCB that carries said printed circuit.

9. The device defined in claim 8 wherein said PCB comprises a pair of electrically conductive layers separated by an electrically insulating layer.

10. The device defined in claim 1 wherein said printed circuit, said at least one LED and said shell constitute a first subassembly, and further including a second subassembly similar to the first subassembly positioned in intimate thermal contact with the other side of said plate opposite the first subassembly.

11. The device defined in claim 1 including a PCB with front and back sides, said printed circuit being printed on said front side, the back side being substantially flat and secured to the adjacent side of the plate so that said back side is in intimate thermal contact with the plate whereby any heat from the at least one LED is conducted away by the plate;

a base with a plurality of electrical contacts and adapted to be coupled to a lamp socket to establish electric connections therewith;

mounting structure for mounting the base to the plate so that the base is substantially collinear to the plate, and an electrical connection device connecting the at least one LED to the electrical contacts in the base.

12. The device defined in claim 11 and further including a drive circuit connected electrically to the contacts in the base for converting alternating current from a power source to a lower voltage direct current for driving the at least one LED.

13. The device defined in claim 12 wherein said printed circuit constitutes part of the electrical connection device between the at least one LED and the contacts in the base.

14. The device defined in claim 12 wherein the at least one LED includes a plurality of LED groups having different color temperatures, and the drive circuit has separate channels enabling separate control of the LED groups.

15. The device defined in claim 11 wherein the mounting structure comprises a pair of covers for positioning on opposite sides of the plate and base, said covers having surfaces which interfit with the plate and base as well as with each other to secure all those components together.

16. The device defined in claim 11 wherein the plate is composed of at least two superimposed plate layers.

17. The device defined in claim 11 wherein the back side of the PCB and the diffuser rim are secured to the plate by a mounting frame having an open center.

18. The device defined in claim 1 including a mounting frame having opposite first and second sides and an open center;

a PCB with a front side that carries said printed circuit, and a back side that is substantially flat, said PCB being supported by the frame so that the back side of the PCB is more or less flush with the first side of the frame and the at least one LED is opposite said open center, said shell having a rim engaged over the second side of the mounting frame so that the shell surrounds the frame and covers the at least one LED, said frame, PCB and shell constituting a first subassembly, and fastening devices for fastening the first subassembly against one side of the plate so that said back side of the PCB is pressed against the plate and the shell rim abuts the plate, whereby when the at least one LED is energized, a maximum amount of light from the at least one LED is directed through the shell and waste heat from the at least one LED is efficiently conducted away by the plate.

19. The device defined in claim 18 and further including a reflector positioned opposite the second side of the frame, the reflector having a reflective surface facing the shell and one or more light-transmitting windows opposite the at least one LED to allow light therefrom to shine into the shell.

20. The device defined in claim 19 wherein the reflector is a metallized plastic film.

21. The device defined in claim 18 and further including a thermally conductive layer sandwiched between said back side of the PCB and the plate.

22. The device defined in claim 21 wherein said layer is an electrically insulating adhesive layer.

23. The device defined in claim 18 wherein the shell is substantially hemispherical in shape.

24. The device defined in claim 18 wherein the shell has the general shape of an oblate hemisphere.

25. The device defined in claim 15 wherein the shell is translucent.

26. The device defined in claim 18 wherein the shell is transparent.

27. The device defined in claim 18 wherein said frame includes a plurality of flexible resilient fingers extending from between said sides of the frame towards said open center and on which said one side of the PCB is seated, and a plurality of clips extending from the frame that engage the PCB, thereby securing the PCB to the frame.

28. The device defined in claim 18 wherein the fastening devices include a plurality of clips projecting from said first side of the frame, and a corresponding plurality of openings in the plate for receiving the clips.

29. The device defined in claim 28 and further including a plurality of locating pins projecting from the first side of the frame, and a corresponding plurality of locating holes in the plate for snugly receiving different ones of said locating pins.

30. The device defined in claim 28 wherein the fastening devices include a bracket positioned against the other side of the plate, said bracket being formed with a plurality of detents and said clips being dimensioned to engage the detents so that the plate is clamped between the frame and the bracket.

31. The device defined in claim 18 and further including a second subassembly similar to the first subassembly, and second fastening devices for fastening the second subassembly against the other side of the plate.

32. The device defined in claim 31 wherein the plate has openings, and the first and second fastening devices include a plurality of clips projecting from the first side of each frame through selected different ones of said openings and engaging a corresponding plurality of detents on the other frame so that the plate is clamped between said first and second subassemblies.

33. The device defined in claim 32 and further including a plurality of locating pins projecting from the first side of the frame in each subassembly, and a plurality of locating holes in the plate for snugly receiving different ones of said plurality of locating pins.

34. The device defined in claim 33 wherein the first and second frames are angularly offset from one another about an axis perpendicular to the plate.

35. The device defined in claim 18 wherein the plate is flat.

36. The device defined in claim 18 wherein the plate is curved with sides which surround the frame and extend beyond the shell.

37. The device defined in claim 18 wherein the plate is comprised of a pair of similar superimposed plate layers.

38. The device defined in claim 18 wherein the at least one LED includes LED groups having different color temperatures, and further including a plural-channel drive circuit for separately controlling the different LED groups.

39. A lighting fixture comprising:

a rigid, thermally conductive sheet having a plurality of openings;

a corresponding plurality of solid state lighting devices as defined in claim 1, whose plates are designed and dimensioned to engage over and cover different ones of said openings;

securing devices for releasably securing each of said plates to the sheet so that the plates are in intimate thermal contact with the sheet;

an electrical bus for connection to a power source, and electrical couplings for releasably electrically connecting the at least one LED of each of said lighting devices separately to the bus so that a failed one of said lighting devices can be removed easily from the fixture and replaced without disturbing the remaining lighting devices.

* * * * *

UNITED STATES PATENT AND TRADEMARK OFFICE

CERTIFICATE OF CORRECTION

PATENT NO. : 8,926,123 B2
APPLICATION NO. : 13/697890
DATED : January 6, 2015
INVENTOR(S) : John E. Thrailkill It is certified that error appears in the above-identified patent and that said Letters Patent is hereby corrected as shown below:

In the Specification:

Col. 1, lines 6-8, should read
This application is a national stage entry of PCT/US2011/000741, filed April 28, 2011, and a continuation-in-part of Ser. No. 12/785,602, filed May 24, 2010, the contents of which are hereby incorporated by reference herein.

Signed and Sealed this
Fifteenth Day of March, 2016

Michelle K. Lee

Michelle K. Lee
*Director of the United States Patent and Trademark Office*